United States Patent [19]

Endo

[11] 4,180,213

[45] Dec. 25, 1979

[54] ROTOR OF A COARSE-REDUCTION IMPACT CRUSHER

[75] Inventor: Makoto Endo, Yokohama, Japan

[73] Assignee: Matsuzaka Company Ltd., Japan

[21] Appl. No.: 895,596

[22] Filed: Apr. 12, 1978

[51] Int. Cl.[2] ..... B02C 13/28

[52] U.S. Cl. ..... 241/192; 241/191

[58] Field of Search ..... 241/189 R, 189 A, 191, 241/192, 195

[56] References Cited

U.S. PATENT DOCUMENTS

| | | | |
|---|---|---|---|
| 3,531,055 | 9/1970 | Alt | 241/192 |
| 3,784,117 | 1/1974 | Koenig et al. | 241/191 |
| 3,979,078 | 9/1976 | Boddeker et al. | 241/191 |

FOREIGN PATENT DOCUMENTS

| | | | |
|---|---|---|---|
| 2347350 | 7/1974 | Fed. Rep. of Germany | 241/192 |
| 1454633 | 11/1976 | United Kingdom | 241/191 |

*Primary Examiner*—Howard N. Goldberg

*Attorney, Agent, or Firm*—Hill, Van Santen, Steadman, Chiara & Simpson

[57] ABSTRACT

A rotor for a coarse reduction impact crusher with exchangeable blow bars including a rotor disk to be driven in rotation with a plurality of radially facing recesses in the periphery and the bars locked in the recesses between a supporting element welded in the recess on the trailing side thereof and a shoe being U-shaped and locked over a projection on the rotor disk with a pair of clamping keys securing the shoe with one of the keys being U-shaped, and the keys being removable axially, and the blow bar having forwardly and rearwardly extending teeth with inclined outwardly facing surfaces to lock beneath corresponding surfaces on the supporting element.

12 Claims, 4 Drawing Figures

ROTOR OF A COARSE-REDUCTION IMPACT CRUSHER

BACKGROUND OF THE INVENTION

The invention relates to improvements in rotors in coarse reduction impact crushers with replaceable blow or impact bars arranged on the circumference. More particularly, the invention relates to an improved support arrangement for carrying the blow bars in the rotor disk recesses whereby the bar is firmly and reliably held in place, but is readily and easily removed.

An example of a rotor for a coarse reduction impact crusher is illustrated in the German laid open specification No. 2,147,920. In a construction of this type, a rotor disk is employed which has a rotor shoe covering the surface projecting against the direction of rotation toward the recess of the rotor disk, with the surface facing outwardly and the surface facing the rotor shaft as well as the lateral surface of the projection. The rotor shoe is held in place by means of a screw extending parallel to the rotor shaft, which screw is guided through a bore of the surface covering the projection laterally. These screws are subjected to the comminution process to high impact stresses so that deformation and loosening occurs. Since the rotor shoe abuts on one side of the rotor disk when the screw is removed or dropped out, a loosening of the rotor shoe from the rotor disk occurs so that the blow bar is no longer fixed. Further problems can occur or can be expected from this type of fastening of the rotor shoe which occur with corrosion whereby the removability of the beater bars is impaired. A known connection of this type between the rotor shoe and rotor disk is operably unreliable, and the exchange and replacement of blow bars is involved with difficulties in many cases.

It is accordingly an object of the present invention to provide a rotor for coarse reduction crusher and to provide an improved mounting and connection between the blow bar and rotor disks so that a reliable fastening of the blow bar and the rotor disks is provided and at the same time a simple and more rapid installation and disassembly of the bars can be accomplished and is insured.

In accordance with the principles of the present invention, the problem is solved in a manner where the blow bar embraces a projection on the side of the projection facing radially inwardly so that the blow bar has a portion overlapping the rotor disk on both sides and fixed in place by means of clamping elements on the disk.

The clamping elements employed provide uncomplicated and sturdy fastening parts and are constructed so that the disassembly and assembly manipulation upon exchange of the blow bars is very simple. A locking rotor shoe is provided holding the beater bar in place, which overlaps the rotor disk on both sides so that the forces encountered in the comminution process are transferred to the rotor directly on the rotor disk and affect only slightly the tension and clamping elements which do not carry the load of the comminution process. With the connection provided which locks on all sides of the disk, an improved force lock arrangement is achieved between the beater bar and disk, and a particularly reliable and easily manipulable fastening of the blow bars is accomplished.

Other objects and advantages and features as well as equivalent structures which are intended to be covered herein, will become apparent with the teaching of the principles of the invention in connection with the disclosure of the preferred embodiment in the specification, claims and drawings, in which:

DRAWINGS

DESCRIPTION

Figure 1:
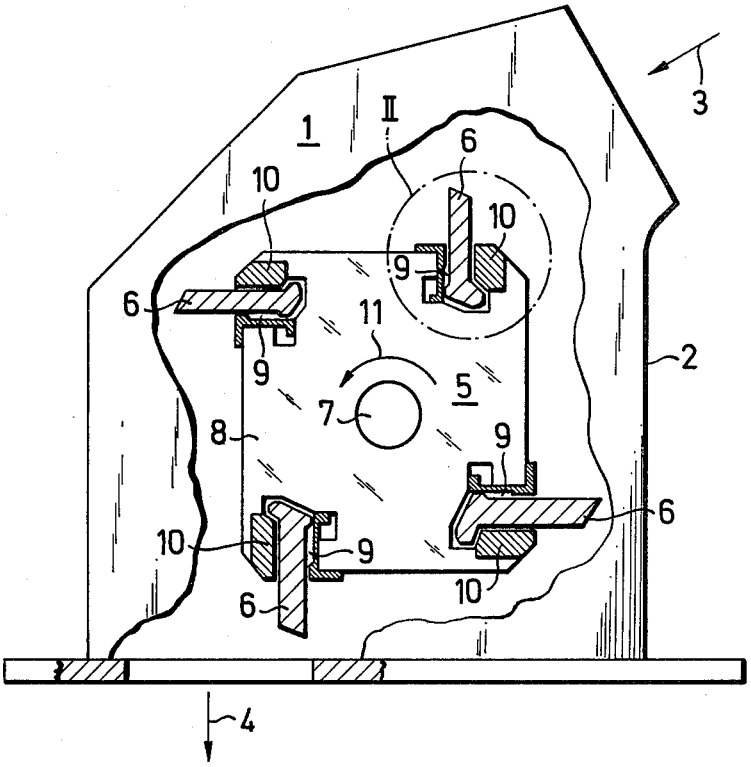
FIG. 1 shows a simplified illustration of a coarse reduction impact crusher with a rotor constructed and operating in accordance with the invention, with a portion of the housing broken away to illustrate the rotor located therein.

FIG. 1 illustrates in some detail a coarse reduction impact crusher 1 having a housing 2 which is partially broken away. Material is loaded into the impact crusher at the location of the arrowed line 3 and the completed comminuted material is discharged from the machine at the arrowed line 4.

Within the housing is a rotor 5 which carries on its circumference four blow bars which also may be called impact bars 6. The rotor 5 is constructed as a disk, as will be recognized by those versed in the art, and includes a shaft 7 on which at least two disks 8 are disposed. The disk has recesses 9 on its periphery on which the impact bars are uniquely secured. The disks 8 mounted on the shaft 7 are interconnected with each other by supporting elements which extend parallel to each other between disks, and are uniquely shaped to coact with other elements for supporting the blow bars in the recess. The shaft 7 and its rotor disks, shown as an entity at 5, is supported at each end on bearings, (not shown), and is provided with a driving motor which is also omitted for purposes of clarity.

The material fed to the impact crusher at the arrowed line 3 passes into the housing and is engaged by the impact bars 6 rotating in the direction of the arrowed line 11, and the material is comminuted between the blow bars 6 and impact or wear plates which are not shown in the drawing. The comminuted material flows outwardly through an opening in the housing at the arrowed line 4.

Figure 2:
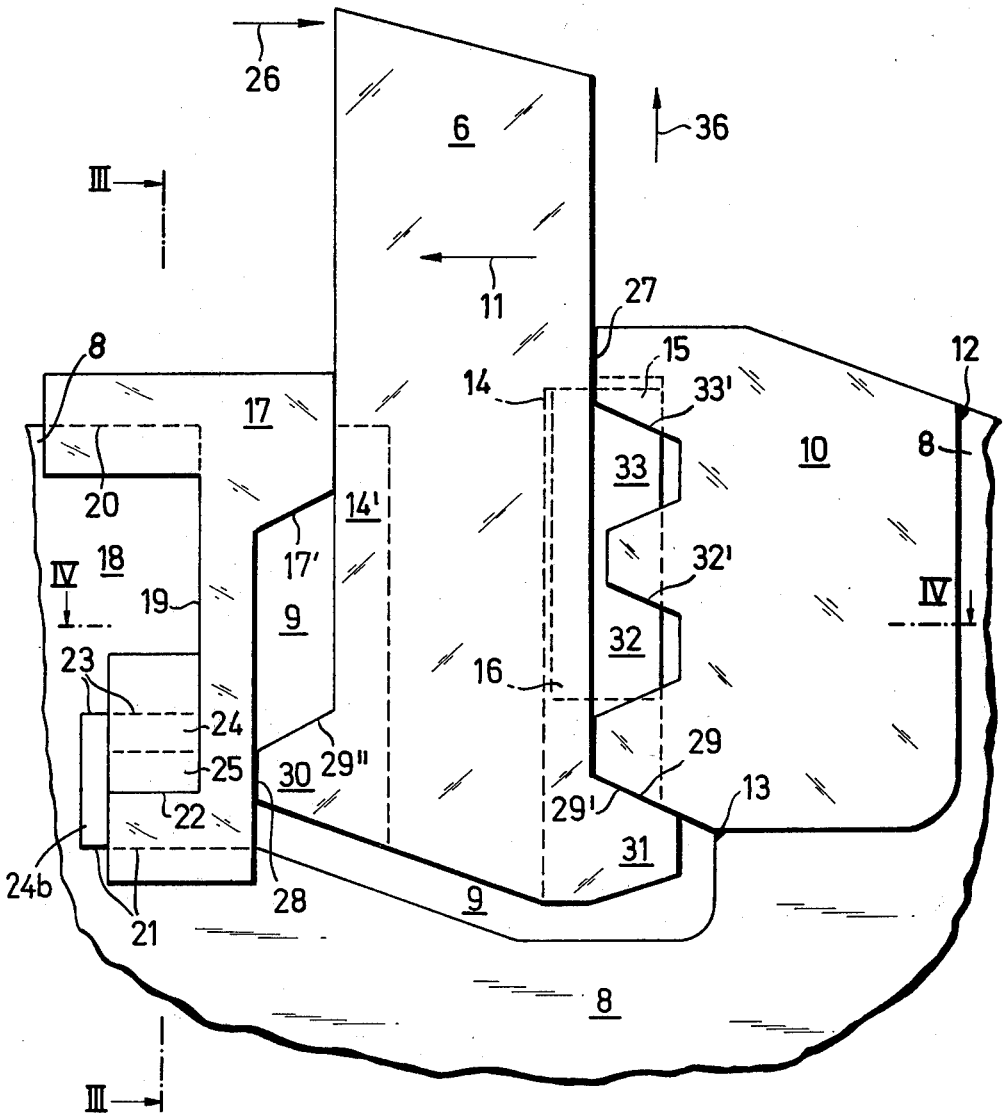
FIG. 2 is a cut-away portion of FIG. 1, as illustrated by the broken line circle II in FIG. 1, and being shown in an enlarged scale.

As illustrated in FIG. 2, which is an enlarged cutaway section of FIG. 1, the disk 8 has a recess 9 in which is located the supporting element 10 with the blow bar 6 carried in the recess 9. The supporting element is welded to the disk at locations 12 and 13. In the blow bar 6 and in the supporting element 10 on the surfaces facing each, are radially extending grooves 14 and 15. In these grooves are located adjusting springs 16 which when provided, are distributed over the length of the blow bar and supporting elements 10. The adjusting springs 16 serve for the axial location of the blow bar relative to the supporting element which is fixedly located on the disk.

The blow bar 6 in the recess 9 is held between the supporting element 10 and a rotor shoe 17 which is removably locked in place at the other side of the recess. The rotor shoe is generally U-shaped in profile as viewed axially in FIG. 2, and has a main vertical portion and two laterally extending legs. On the rotor disk 8 and integral therewith is a circumferentially extending projection 18 which projects into the recess and the rotor shoe is held in its locked position over this projection 18. The outer leg of the rotor shoe 17 seats on the outer surface of the projection which surface is shown at 20. The body of the U-shaped shoe abuts against the circumferentially facing surface 19 of the projection. The inner leg of the rotor shoe 17 seats on the inner surface of the projection, shown at 21.

Figure 3:
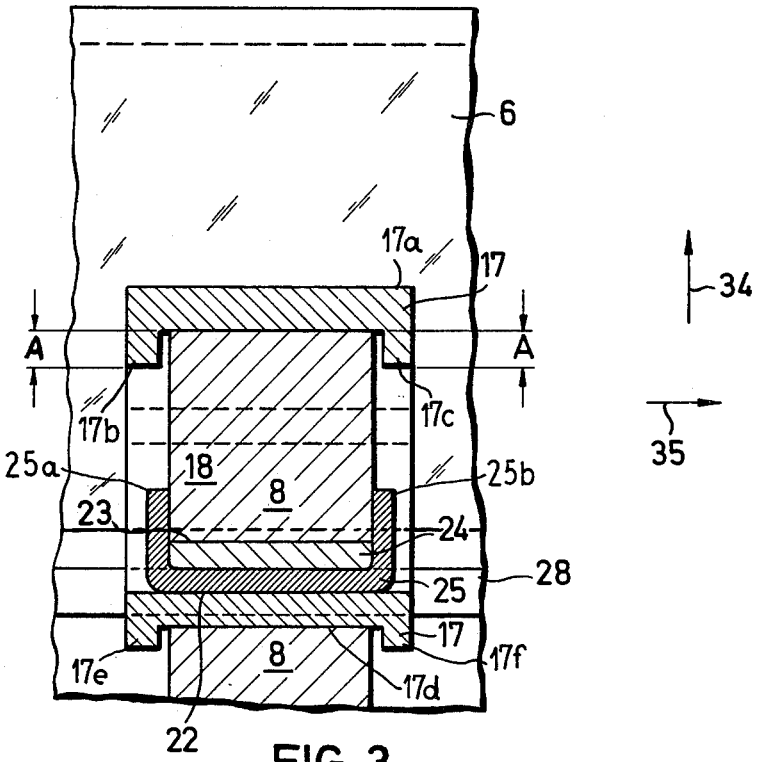
FIG. 3 is a sectional view taken substantially along line III—III of FIG. 2.
Figure 4:
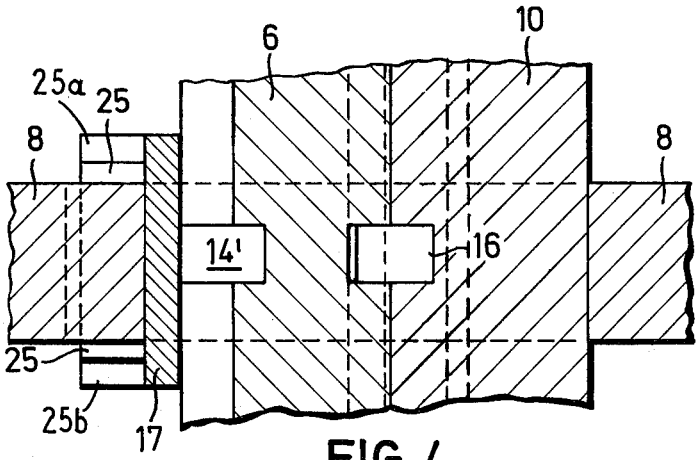
FIG. 4 is a sectional view taken substantially along line IV—IV of FIG. 2.

As illustrated in FIG 3, the one leg 17*a* of the shoe has downwardly extending flanges 17*b* and 17*c* at each side to hold the shoe axially against the sides of the projection 18 of the rotor. Similarly, the lower leg 17*d* of the shoe has flanges 17*e* and 17*f* which project down along each side of the rotor disk 8, bearing in mind that the shoe is shown in its lowermost locked position in FIG. 3, and that it will be permitted to be raised to be unlocked and pulled axially out of the recess 9.

As shown in FIGS. 2 and 3, the space between the surface at 22 (which is the upwardly facing surface of the lower leg 17*b*), and the lower surface 23 of the projection 18 is filled by first and second sheet metal locking keys 24 and 25. The sheet metal locking key 25 has lateral ears 25*a* and 25*b* which are bent upwardly against the sides of the projection 18 and this holds the second key 25 in its axial position, and the ears also lock the first key 24 in its axial position.

The first key 24 is a simple square member which is inserted between the lower surface 23 of the projection 18 and the second key 25. Said first key 24 is axially fixed by means of the two bent lateral ears 25*a* and 25*b*. A cavity 24*b*, which is a portion of the recess 9, is circumferentially located between the lower portion of the shoe 17 and the rotor disc 8.

With the arrangement shown, impact stress is occasioned by means of the comminuting process on the blow bars, which occurs in the direction of the arrow 26 of FIG. 2, that produce a force couple in a circumferential direction. This force couple on the blow bar is absorbed by the contact surface 27 between the blow bar and the supporting element 10. The force coupled in the other direction is taken up by means of the contact surface 28 between the rotor shoe 17 and a forwardly extending tooth 30 on the blow bar 6.

The other force acting on the blow bar is centrifugal force which tends to throw it outwardly and this force is taken up on the inclined surface 29 of a rearwardly extending tooth 31 on the blow bar 6, and the surface 29' of the tooth is in surface-to-surface engagement with another surface 29 on the supporting element 10.

The blow bar 6 is provided with the teeth 30 on the leading face and 31 on the trailing face, which teeth extend continuously for the longitudinal extent of the bar. These teeth are generally trapezoidal shaped in cross section, and are arranged radially offset so as to permit reverse mounting and adjustment in radial position of the blow bar. The teeth are of the same size and symmetry and their upwardly facing surfaces shown at 29 and 29" correspond in angle so as to be able to engage in surface-to-surface contact on the surfaces 29', 32' and 33' as shown in FIG. 2.

The supporting element 10 is provided with axially extending grooves 32 and 33 which are also trapezoidal shaped in cross section to correspond with the shape of the teeth 30 and 31. The sizes of the grooves 32 and 33 are such that the blow bar may be installed in the manner illustrated, or may be reversed so that the projection 30 may be brought into the recesses 32 or 33. When this reverse position is used, a vertical groove 14' on the leading face of the blow bar 6 is provided to correspond with the radial groove 15 of the supporting element 10 so that the springs 16 will be between the grooves 15 and 14'.

During operation, wear occurs on the blow bars which results in a removal of material at the outer edges. For better utilization of the material, the bar can be gradually moved outwardly by the tooth into one of the grooves 32 or 33, or by reversing the beater bar so that the forwardly extending tooth 30 extends rearwardly into one of the grooves 32 and 33. In the outermost position with the tooth 30 in the groove 33, the upper surface 29 of the tooth 31 will engage beneath an inclined surface 17' of the shoe, thus adding additional stabilizing strength to the blow bar in its most outward position where its cantilever support arm is at a minimum length.

FIG. 3 illustrates the relationship of the parts in the locked position. For removal of the blow bar and replacement or readjustment, first the ears such as 25*a* are bent laterally, and then the two parts 24 and 25 can be driven axially out in the direction of the arrowed line 35. Thereafter the shoe 17 can be moved radially outwardly in the direction of the arrow 34, and it can be slid axially off of the projection 18.

After removal of the shoe 17, the spring connection between the supporting element and the blow bar 6 will be loosened by shifting the bar in a circumferential direction as indicated by the arrowed line 11 in FIG. 2. The blow bar then can be removed from the rotor 5 either axially or in a circumferential direction as indicated by the arrowed line 36. For remounting of the blow bar, the bar is placed in the recesses 9 against the direction of the arrow 36 and brought into engagement with the adjusting spring 16 of the supporting element. The relatively light shoes 17 are pushed axially onto the projections 18 and then pushed radially inwardly by the amount A, FIG. 3, and the two keys 24 and 25 are driven axially into place locking the shoe. One or both ears 25*a* and 25*b* are bent upwardly so that both extend into the relative position shown in FIG. 3 to complete the locking operation.

Thus, it will be seen that I have provided an improved rotor and blow bar connection which meets the objectives and advantages above set forth and which results in a better longer operating mechanism wherein the locking parts do not sustain forces during operation and are not subjected to corrosion or wear which makes them inoperative for removal.

I claim as my invention:

1. A rotor for a coarse reduction impact crusher with exchangeable blow bars comprising in combination:

a rotor disk to be driven in rotation having a plurality of radially facing recesses on the periphery;

a supporting element on the trailing side of said recesses secured to the rotor;

a circumferentially rearwardly extending projection on the leading side of said recesses;

a removable shoe in said recess embracing said projection on both lateral sides and on the radially inwardly facing side;

clamping keys securing said shoe to said disk; and a blow bar in said recesses clamped therein between shoe and said supporting element so that the shoe can be removed by removal of said clamping keys for removal and replacement of said bar.

2. A rotor for a coarse reduction impact crusher with exchangeable blow bars constructed in accordance with claim 1:

wherein said clamping keys are in the form of sheet metal units located between said projection and a surface of the rotor shoe embracing the projection on the radially inwardly facing side.

3. A rotor for a coarse reduction impact crusher with exchangeable blow bars comprising in combination:

rotor disk to be driven in rotation having a plurality of radially outwardly facing recesses in the periphery;

a supporting element on the trailing side of said recesses secured to the rotor;

a removable shoe in said recesses on the foward side thereof;

a removable clamping key means holding said shoe in position; and a blow bar in said recesses clamped therein between said shoe and said supporting element so that the shoe can be removed by removal of said key means for removal of the shoe and said bar;

said bar having a rearwardly circumferentially extending tooth engaging beneath a radially inwardly facing surface of the supporting element and having forwardly and rearwardly facing side surfaces respectively engaging said shoe and said supporting element.

4. A rotor for a coarse reduction impact crusher with exchangeable blow bars constructed in accordance with claim 3:

wherein said tooth has an inclined holding surface being at an angle to a line tangent to the direction of rotation of said surface with the angle of the surface corresponding to the radially inwardly facing surface of the supporting element.

5. A rotor for a coarse reduction impact crusher with exchangeable blow bars constructed in accordance with claim 4:

and including a forwardly extending tooth on the beater bar so that the bar may be reversed in its position in the recess with the forwardly extending tooth facing rearwardly to engage the inwardly facing surface of the supporting element.

6. A rotor for a coarse reduction impact crusher with exchangeable blow bars constructed in accordance with claim 5:

and including a radially inwardly facing surface on the shoe for engagement with the forwardly extending tooth on the blow bar.

7. A rotor for a coarse reduction impact crusher with exchangeable blow bars constructed in accordance with claim 3:

including at least one additional radially inwardly facing surface on the supporting element spaced outwardly from the first surface so that the tooth can be mounted at a plurality of positions at different radial locations to compensate for wear.

8. A rotor for a coarse reduction impact crusher with exchangeable blow bars constructed in accordance with claim 7:

and including a forwardly facing tooth on the beater bar with said forwardly facing tooth being capable of engagement with the plurality of radially inwardly facing surfaces on the supporting element when the bar is reversed.

9. A rotor for a coarse reduction impact crusher with exchangeable blow bars constructed in accordance with claim 7:

wherein each of the teeth have a radially outwardly facing surface at an angle to a line tangential to the rotation of the bar and said angle on each of the teeth is the same.

10. A rotor for a coarse reduction impace crusher with exchangeable blow bars comprising in combination:

a rotor disk to be driven in rotation having a plurality of radially facing recesses in the periphery;

a supporting element on the trailing side of said recesses secured to the rotor;

a circumferentially rearwardly extending projection on the leading side of said recesses embracing said projection radially inwardly and radially outwardly of the projection with the legs of the shoe above and below the projection and the outer leg in engagement with the projection;

first and second clamping keys between the inner leg of the shoe and the inner surface of said projection locking said shoe in place; and a blow bar in said recesses clamped therein between said shoe and said supporting element so the shoe can be removed by removal of the keys for removal and replacement of said bar.

11. A rotor for a coarse reduction impact crusher with exchangeable blow bars constructed in accordance with claim 10:

wherein said first key is located against the inwardly facing surface of said projection, and the second key is between the first key and the shoe and is U-shaped with side legs engaging the sides of the projection.

12. A rotor for a coarse reduction impact crusher with exchangeable blow bars constructed in accordance with claim 11:

wherein the first key is L-shaped with a leg located between the second key and the projection and another leg extending in a radially inwardly facing direction.

* * * * *